US006225955B1

(12) United States Patent
Chang et al.

(10) Patent No.: US 6,225,955 B1
(45) Date of Patent: May 1, 2001

(54) DUAL-MODE, COMMON-APERTURE ANTENNA SYSTEM

(75) Inventors: Yu-Wen Chang, Rancho Palos Verdes, CA (US); Elmer Freibergs, Toms River; Lothar Wandinger, Elberon, both of NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 793 days.

(21) Appl. No.: 08/497,064

(22) Filed: Jun. 30, 1995

(51) Int. Cl.[7] ..... H01Q 19/13
(52) U.S. Cl. ..... 343/720; 343/725; 343/779
(58) Field of Search ..... 343/720, 725, 343/779, 781 P, 781 CA, 840; H01Q 15/00, 15/14, 15/16, 19/13

(56) References Cited

U.S. PATENT DOCUMENTS 4,284,991 * 8/1981 Dupressoir ..... 343/725

FOREIGN PATENT DOCUMENTS

4010242 * 2/1991 (DE) ..... 343/725

* cited by examiner

*Primary Examiner*—Michael C. Wimer
(74) *Attorney, Agent, or Firm*—Michael Zelenka; John M. O'Meara

(57) ABSTRACT

A multi-mode, common-aperture antenna system capable of simultaneously transmitting and/or receiving electromagnetic radiation in at least two frequency bands. The antenna system includes a first beam antenna comprised of a parabolic reflector and four open-ended waveguides that act as an antenna feed. The parabolic reflector focuses radiation along a first beam axis that may be scanned electronically or mechanically. The four waveguides extend from the focus of the parabolic reflector to transceivers that transmit and/or receive radiation in a first mode. The transceivers mount at the rear of the reflector. The antenna system also includes a second beam antenna which operates in a second mode, e.g. optical or infrared (IR) mode. The second beam antenna includes a small opening in the parabolic reflector that acts as an optical aperture for a focusing lens mounted at the rear of the reflector and positioned coaxially with the small opening. An optical apparatus occupies the focal plane of the focusing lens. The optical apparatus generates and/or senses optical radiation incident with the beam axis of the second beam antenna.

19 Claims, 2 Drawing Sheets

DUAL-MODE, COMMON-APERTURE ANTENNA SYSTEM

GOVERNMENT INTEREST

The invention described herein may be manufactured, used and licensed by or for the Government for governmental purposes without the payment to us of any royalties thereon.

BACKGROUND OF THE INVENTION

1. Field of the Invention

This invention relates in general to the field of antennas. More particularly, the invention relates to dual-mode, common-aperture antenna systems that transmit and/or receive electromagnetic radiation in at least two frequency bands.

2. Description of the Prior Art

Radar is an active system which has been used extensively for detecting and determining the range and direction of distant objects such as ships and aircraft. Radar does this by illuminating the object with radiation and then receiving, analyzing and displaying the reflections. Many modern radar systems have sufficient resolving power to permit the identification of an object by analyzing its characteristic reflected pattern, or signature, as displayed by detection and classification equipment. In general, the resolution of a radar system and, therefore, its ability to identify objects from its signature increases as the operating frequency increases.

The ability of radar systems to effectively illuminate an object and receive a useful reflection can also vary with its operating frequency. For example, radar operation is often impacted by adverse weather conditions that can significantly alter the electromagnetic transmittance of the atmosphere. Specifically, while dense fog can have little effect on a microwave radar beam, it can quickly attenuate the short-wavelength beam of, for example, a laser radar. Those skilled in the art have therefore recognized that while most high-resolution radar systems produce good object-identification signatures, they can have limited ability at finding and/or illuminating objects under, for example, adverse weather conditions. Conversely, while many low-resolution radar systems may produce poor object-identification signatures, they have superior capacity at quickly finding objects under most operating conditions.

Consequently, in the field of object detection and identification, it has been found desirable to employ multi-mode radar systems that transmit and/or receive radiation in a number of frequency bands. These multi-mode radar systems have important applications in various apparatus such as aircraft landing systems, target acquisition and guidance equipment in smart bombs, obstacle detection radar for high-speed trains, marine navigation equipment, vehicle collision avoidance systems, and the like. In many of these applications, the radar system must be mounted in an apparatus having limited room and/or be capable of tolerating high acceleration forces. As such, one of the most critical problems confronting designers of multi-mode radar systems has been the low-cost fabrication of efficient, dual-mode antennas that are simple, compact and sturdy. The present invention fulfills this need.

SUMMARY OF THE INVENTION

It is, therefore, an object of the present invention to provide an efficient multi-mode, common-aperture antenna system capable of simultaneously transmitting and/or receiving electromagnetic radiation in a number of frequency bands.

Another object of the invention is the provision of a common-aperture antenna system that may be used as a front-end of various millimeter-wave/or microwave/optical transceivers.

A further object of the present invention is to provide a dual-mode, common-aperture antenna system that is efficient, compact, sturdy, easy to align and inexpensive to fabricate.

The general purpose of this invention is to provide an improved low-cost, efficient and reliable, multi-mode antenna capable of simultaneously transmitting and/or receiving radiation in at least two frequency bands. To attain this, the present invention contemplates a unique common-aperture antenna system having first and second beam antennas. The first beam antenna has a first antenna feed and a first beam-forming device, defining a first antenna aperture, for forming a first radiation pattern along a first beam axis. The second beam antenna has a second antenna feed and a second beam-forming device, defining a second antenna aperture, for forming a second radiation beam pattern along a second beam axis. The second antenna aperture is less than half the size of and located within the boundary of the first antenna aperture. A radiation energy device connects to the first antenna feed for feeding radiation in a first frequency band and to the second antenna feed for feeding radiation in a second frequency band different from the first frequency band.

More specifically, the present invention is directed to a multi-mode, common-aperture antenna system capable of simultaneously transmitting and/or receiving electromagnetic radiation in at least two frequency bands. The antenna system includes a first beam antenna comprised of a parabolic reflector and four open-ended waveguides that act as an antenna feed. The parabolic reflector focuses radiation along a first beam axis that may be scanned electronically or mechanically. The four waveguides extend from the focus of the parabolic reflector to transceivers that transmit and/or receive radiation in a first mode. The transceivers mount at the rear of the reflector. The antenna system also includes a second beam antenna which operates in a second mode, e.g. optical or infrared (IR) mode. The second beam antenna includes a small opening in the parabolic reflector that acts as an optical aperture for a focusing lens mounted at the rear of the reflector and positioned coaxially with the small opening. An optical apparatus occupies the focal plane of the focusing lens. The optical apparatus generates and/or senses optical radiation incident with the beam axis of the second beam antenna.

BRIEF DESCRIPTION OF THE DRAWINGS

Other objects, features, details, advantages and applications of the invention will become apparent in light of the ensuing detailed disclosure, and particularly in light of the drawings wherein.

DETAILED DESCRIPTION OF THE PREFERRED EMBODIMENT

Figure 3:
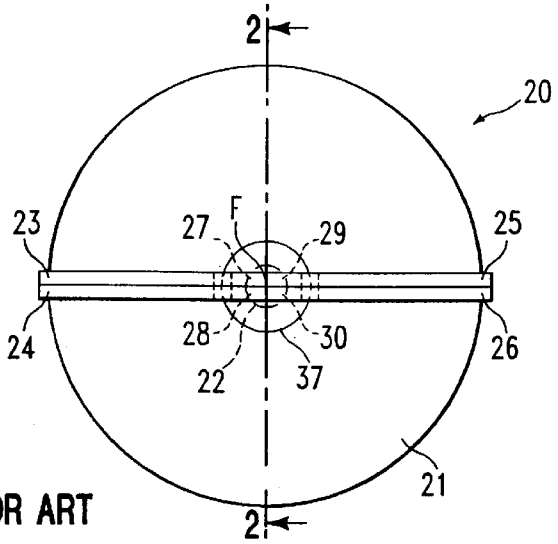
PRIOR ART FIG. 3
FIG. 3 is a schematic representation of an end view of the FIG. 2 prior art dual-mode antenna system.
Figure 1:
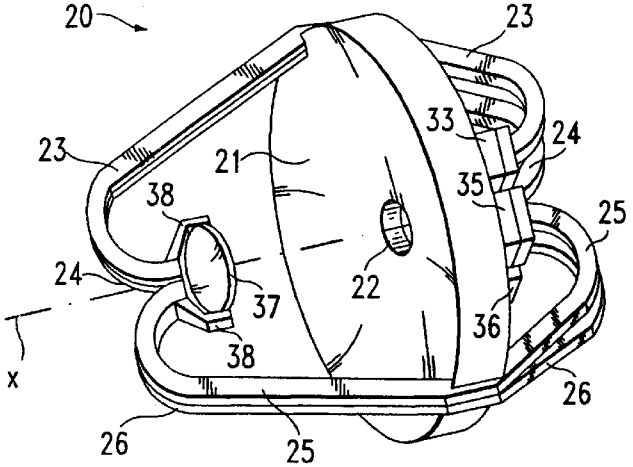
PRIOR ART FIG. 1
FIG. 1 is a pictorial diagrammatic representation of a prior art dual-mode antenna system.
Figure 2:
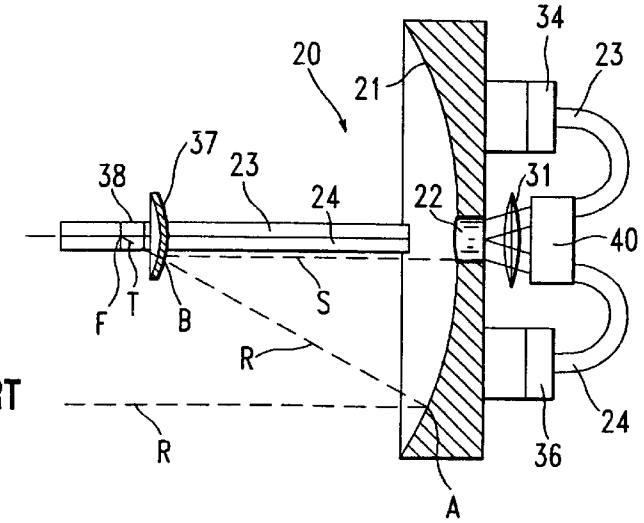
PRIOR ART FIG. 2
FIG. 2 is a schematic representation of a side view showing the major elements of the FIG. 1 prior art dual-mode antenna system.

Referring now to the drawings, FIGS. 1–3 exemplify a conventional dual-mode antenna system 20 capable of simultaneously operating in two frequency bands. Antenna system 20 includes a concave parabolic main reflector 21 having a parabolic axis X and a focal point F. Four open-ended waveguides 23–26 feed radiation to and from reflector 21 via their respective open ends 27–30. Open ends 27–30 are symmetrically positioned about focal point F and face toward main reflector 21 (see FIG. 3).

Parabolic main reflector 21 and waveguides 23–26 represent a conventional microwave and/or millimeter-wave antenna typically having a narrow-beam antenna pattern that may be mechanically or electronically scanned. For example, the antenna beam may be electronically scanned by varying the relative phase and/or frequency of the radiation being fed by each of the four waveguides 23–26 in a well known manner. Of course, antenna system 20 may also be mounted for movement on a conventional mechanical scanner.

The periphery of main reflector 21 supports waveguides 23–26 which extend from focal point F to respective microwave or millimeter-wave transceiver units 33–36 mounted at the rear of main reflector 21. Waveguides 23 and 24 mount at one side of main reflector 21 and extend generally in side-by-side relation, while waveguides 25 and 26 mount at the opposite side of main reflector 21 and also extend in side-by-side relation. The manner by which transceiver units 33–36 generate and detect microwave or millimeter-wave radiation, and the way that waveguides 23–26 transmit radiation between open ends 27–30 and transceiver units 33–36 is well known and, therefore, will not be further described.

In addition to its microwave or millimeter-wave antenna configuration, antenna system 20 also includes an optical antenna. The optical antenna comprises central opening 22 which acts as an optical aperture for optical focusing lens 31 positioned at the rear of main reflector 21. Focusing lens 31, circular opening 22 and main reflector 21 are coaxially aligned on axis X. Additionally, two arms 38, which are fixed to waveguides 23–26, mount convex parabolic subreflector 37 coaxially with respect to axis X near open ends 27–30. The convex reflective surface of subreflector 37 has an unobstructed view of the concave reflective surface of main reflector 21. Subreflector 37 is typically fabricated from a dielectric material having a convex reflective surface that reflects optical energy while being substantially transparent to microwaves or millimeter waves. For example, subreflector 37 may be formed from a silicon material having an optically polished convex surface that is coated with an optically reflective layer of germanium-thorium-fluoride ($GeThF_4$).

FIG. 2 depicts ray R, representing one ray of a typical incoming or outgoing radiation beam, traveling parallel to axis X and reflecting from main reflector 21 at point A. FIG. 2 also shows ray R traveling between point A and point B on subreflector 37. Further shown are ray T traveling between point B and focal point F, and ray S traveling between point B and lens 31 via opening 22. These illustrations portray typical transmission paths followed by radiation received or transmitted by antenna system 20. Specifically, a representative ray of microwave or millimeter-wave radiation would follow the path of rays R and T, reflecting from reflector 21 but passing through the low-loss subreflector 37. However, a ray of optical radiation would normally follow the path of rays R and S, reflecting from subreflector 37 and main reflector 21. Focusing lens 31 focuses optical radiation received by antenna system 20 onto its focal plane for processing by optical apparatus 40. Optical radiation may also be generated by optical apparatus 40 and fed to focusing lens 31, optical subreflector 37 and main reflector 21 for transmission by antenna system 20. In this regard, optical apparatus 40 may include a laser for generating optical radiation and/or an optical sensor array for detecting optical images or portions of optical images received by antenna system 20.

It should be understood that the foregoing is a specific description of only one exemplary type of dual-mode, common-aperture antenna system found in the prior art. The operating frequencies of many of these prior art antenna systems include one frequency band located between one to 300 gigahertz (GHz) and a second frequency band located in the infrared (IR) band. The term "optical" as used herein is meant to include energy extending above the lower GHz range, such as IR, visible light, ultraviolet (UV), etc.

Although such prior art antenna systems have served the purpose, they are often expensive and difficult to fabricate. For instance, so that only a minimum of the optical radiation is blocked, subreflector 37 must be very small, e.g. having a diameter in the order of ⅛ to ¼ the diameter of main reflector 21. Consequently, antenna manufacturers usually encounter difficulty in aligning subreflector 37 to achieve optimal microwave and millimeter-wave performance while obtaining acceptable optical detection response. Also, diffraction and reflection of some of the microwave and millimeter-wave radiation by small subreflector 37 can critically affect the antenna performance. The difficulty in designing and aligning subreflector 37 becomes increasingly more difficult as the size of the aperture of main reflector 21 decreases when designing an antenna for operation in the millimeter-wave and IR regions. Further, mechanical assembly and support of a small fragile subreflector 37 to form a rugged antenna structure that will withstand high acceleration forces can be very difficult and time consuming.

Figure 6:
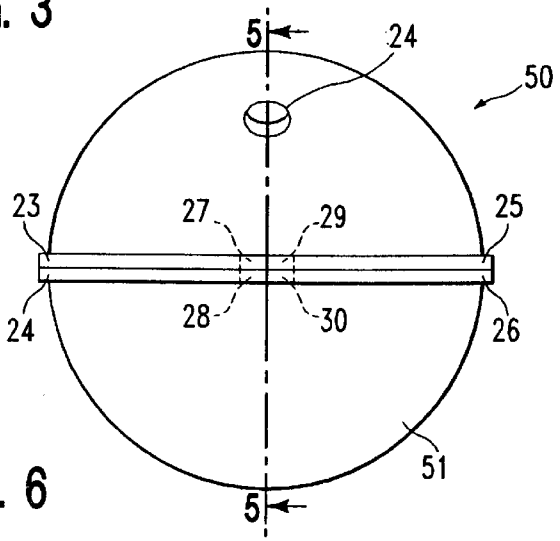
FIG. 6 is a schematic representation similar to FIG. 3 showing an end view of the preferred embodiment of FIG. 4.
Figure 4:
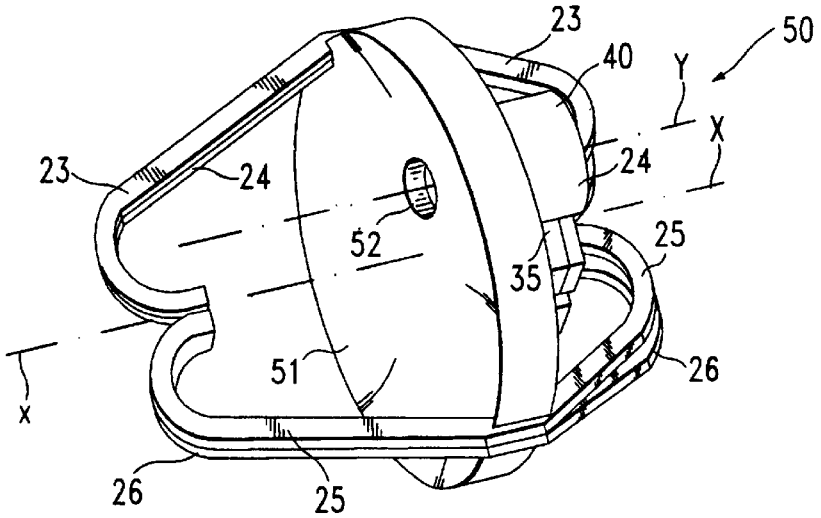
FIG. 4 is a pictorial diagrammatic representation similar to FIG. 1 showing a preferred embodiment of a dual-mode antenna system in accordance with the present invention.
Figure 5:
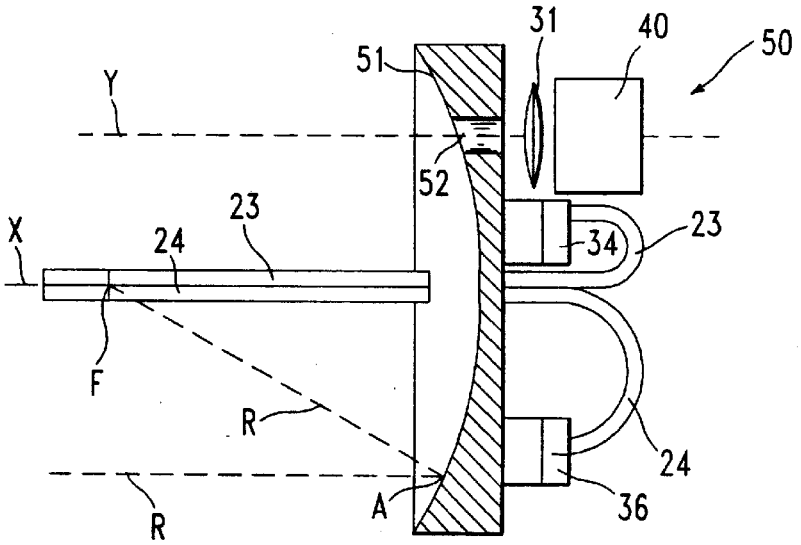
FIG. 5 is a schematic representation similar to FIG. 2 showing a side view of the major elements of the preferred embodiment of FIG. 4.

FIGS. 4–6 illustrate a preferred embodiment of a dual-mode, common-aperture antenna system 50 that avoids the problems associated with subreflectors. Antenna system 50, which is similar to antenna system 20 as indicated by the common reference characters, comprises concave parabolic reflector 51 with focal point F and parabolic axis X. Reflector 51 includes off-center opening 52 which acts as an optical aperture for focusing lens 31 and optical apparatus 40 positioned at the rear of main reflector 51. Focusing lens 31 and optical apparatus 40 are coaxially aligned on axis Y which substantially parallels parabolic axis X. Transceiver units 33–36 also mount at the rear of reflector 51. Open-ended waveguides 23–26 extend from respective transceiver units 33–36 to focal point F in the same manner as described above with respect to antenna system 20. Also, open ends 27–30 are symmetrically positioned about focal point F and face toward reflector 51. Finally, optical apparatus 40 includes means for transmitting and/or receiving optical radiation. For example, when optical apparatus 40 includes a laser, optical radiation may be directly transmitted in the direction of axis Y without being reflected. Additionally, optical apparatus 40 preferably includes an optical sensor, such as a focal plane array (FPA) of optical detectors capable of detecting optical images or portions thereof viewed from a direction centered on axis Y.

Because opening 52 is located off-center, it has a relatively unobstructed forward view. Consequently, antenna system 50 eliminates the need for a complex and costly subreflector of the type used in antenna system 20. As such, the difficult, time-consuming alignment problems associated with subreflector 37 are avoided in antenna system 50.

Obviously many modifications and variations are possible. For example, the invention applies equally well to other antenna shapes and configurations, such as lens-type antennas, flat antennas and antennas having curved reflectors other than parabolic. It is also conceived that more than one off-center opening may be formed in reflector 51, permitting simultaneous operation at more than two modes. Additionally, other antenna feeds may be used. For example, a single open-ended waveguide feed may be substituted for waveguides 23–26. While the preferred embodiment shows four separate transceiver units 33–36, other implementations employing a single transceiver unit to which the four waveguides 23–26 connect are apparent in view of the present teachings.

Although optical or IR radiation is no longer collected from the relatively large-aperture reflector 51, the effective optical aperture in system 50 is more than sufficient. Further, placing opening 52 off-center effectively eliminates the blockage of optical or IR radiation by the waveguides 23–26 as occurs in the prior art systems. In practice, the small-diameter opening 52 represents only a small fraction, e.g., in the order of 2%, of the total surface of reflector 51. Therefore, microwave or millimeter-wave radiation loss and beam distortion due to opening 52 will normally be insignificant. Further, antenna system 50 has the advantage that the optics and the microwave or millimeter-wave antenna elements can be separately adjusted for optimal performance without mutual interference. Beam alignment can also be separately achieved.

Figure 7A:
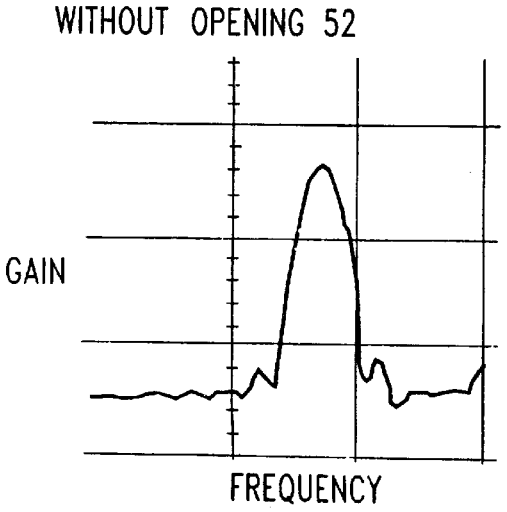
FIGS. 7A and 7B are graphs showing antenna gain as a function of frequency for comparing the radiation patterns of test antenna reflectors useful in understanding the present invention.
Figure 7B:
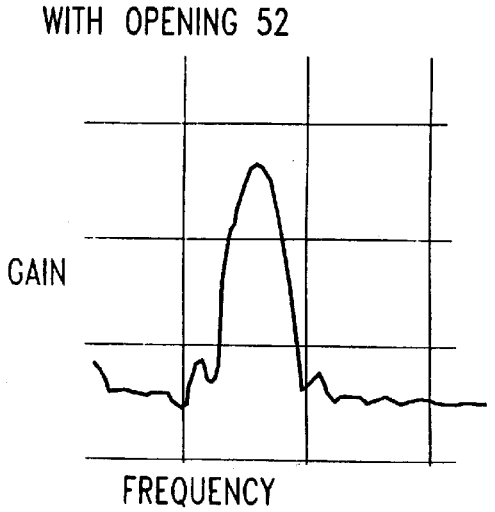

The millimeter-wave beam pattern of a test parabolic reflector comparable to reflector 51 was measured and compared to that of a similar reflector with no off-center opening 52. FIGS. 7A and 7B show the test results. The test reflectors each had a diameter of 8.9 centimeters (3.5 inches). The off-center opening 52 was 1.25 centimeters (0.5 inch) in diameter and was placed 2.0 centimeters (0.8 inch) off-center. The differences between the antenna beam patterns measured for the reflectors with opening 52, as shown in FIG. 7A, and without opening 52, as shown in FIG. 7B, are readily seen to be very small. The antenna degradation due to the presence of opening 52 is virtually unmeasurable. In addition, the experimental version of reflector 51 with opening 52 was placed in front of a test optical apparatus 40 having a conventional (64×64) indium-antimonide (InSb) FPA of IR detectors and a 2.5 centimeter (1.0 inch) diameter IR focusing lens 31 and directed at various objects. Good images of helicopters at a distance of 1.5 kilometers as well as automobiles and personnel were observed and recorded. Finally, a test antenna system 50 was constructed to operate as an IR sensor at 3–5 microns and as a transceiver in the millimeter-wave mode at 94 GHz. Good correlation between the millimeter-wave signals received and the IR images was demonstrated.

It should be understood that the foregoing disclosure relates to only a preferred embodiment of the invention and that numerous modifications or alterations may be made therein without departing from the spirit and the scope of the invention as set forth in the appended claims.

What is claimed is:

1. A multi-mode, common-aperture antenna system comprising:

a first beam antenna having a first antenna feed and a first beam-forming means for producing a first radiation pattern along a first beam axis, wherein said first beam-forming means includes a first radiation-focusing device having a focal axis and an aperture creating an open space entirely through said first radiation-focusing device, said aperture being spaced from a point where said focal axis intersects the first radiation-focusing device;

a second beam antenna having a second antenna feed and a second beam-forming means for producing a second radiation beam pattern along a second beam axis which is spaced from said first beam axis and which passes through said aperture of the first radiation-focusing device; and radiation energy means connected to said first antenna feed for feeding radiation in a first frequency band, and connected to said second antenna feed for feeding radiation in a second frequency band different from said first frequency band.

2. The system of claim 1 wherein said first radiation-focusing device includes a focusing reflector.

3. The system of claim 2 wherein said focusing reflector is a parabolic reflector.

4. The system of claim 3 wherein said first antenna feed includes at least one open-ended waveguide having its open end mounted in a focal plane of said parabolic reflector.

5. The system of claim 3 wherein said first antenna feed includes four open-ended waveguides having their open ends mounted in a focal plane of said parabolic reflector and symmetrically positioned about the focal point of said parabolic reflector.

6. The system of claim 1 wherein said second beam-forming means includes a second radiation-focusing device having a focal axis coincident with said aperture.

7. The system of claim 6 wherein said second radiation-focusing device includes a focusing lens mounted coaxially with said aperture.

8. The system of claim 7 wherein said first radiation-focusing device includes a focusing reflector.

9. The system of claim 8 wherein said focusing reflector is a parabolic reflector.

10. The system of claim 9 wherein said first antenna feed includes at least one open-ended waveguide having its open end mounted in a focal plane of said parabolic reflector.

11. The system of claim 10 wherein said first frequency band lies in the range including electromagnetic microwaves and millimeter-waves, and said second frequency band lies in the optical frequency range.

12. The system of claim 11 wherein said focusing lens is an optical focusing lens, and said radiation energy means includes optical means located in a focal plane of said optical focusing lens for generating and/or sensing optical radiation.

13. The system of claim 12 wherein said second frequency band lies in the infrared (IR) band and said optical means includes a focal plane array of optical detectors.

14. A multi-mode, common-aperture antenna system capable of simultaneously operating in at least two frequency bands comprising:

a first beam antenna comprised of a parabolic reflector and a first antenna feed located at the parabolic focus of said reflector, wherein said parabolic reflector has a focal axis and an aperture creating an open space entirely through said reflector, said aperture being spaced from a point where the focal axis intersects said reflector;

a second beam antenna comprised of a focusing lens having a focal plane, the focusing lens being mounted at the rear of said reflector directly behind said aperture and positioned coaxially with the focal axis of said reflector;

first radiation means for feeding radiation in a first frequency band to said first antenna feed; and second radiation means located in a focal plane of said focusing lens for feeding radiation incident on said focusing lens in a second frequency band different from said first frequency band.

15. The system of claim 14 wherein said first antenna feed includes at least one open-ended waveguide having its open end mounted in a focal plane of said parabolic reflector.

16. The system of claim 14 wherein said first antenna feed includes four open-ended waveguides having their open ends mounted in a focal plane of said parabolic reflector and symmetrically positioned on said reflector about said focus axis.

17. The system of clam 14 wherein said first frequency band lies in the range including electromagnetic microwaves and millimeter-waves, and said second frequency band lies in the optical frequency range.

18. The system of claim 17 wherein said focusing lens is an optical focusing lens, and said second radiation means includes optical means located in a focal plane of said optical focusing lens for generating and/or sensing optical radiation.

19. The system of claim 18 wherein said second frequency band lies in the infrared band and said optical means includes a focal plane array of optical detectors.

* * * * *